United States Patent [19]

Shibata et al.

[11] Patent Number: 4,870,942

[45] Date of Patent: Oct. 3, 1989

[54] DIAGNOSIS DEVICE FOR EXHAUST GAS RECYCLING DEVICE OF INTERNAL COMBUSTION ENGINE

[75] Inventors: Norio Shibata; Hideaki Mizuno, both of Toyota; Kouichi Satoya, Susono; Nobuki Uchitani, Tokushima; Tatsuyoshi Kamohara, Toyota; Kenichi Harada; Mamoru Yoshioka, both of Susono; Takashi Kato, Mishima; Hidemi Ohnaka, Susono, all of Japan

[73] Assignee: Toyota Jidosha Kabushiki Kaisha, Aichi, Japan

[21] Appl. No.: 223,890

[22] Filed: Jul. 25, 1988

[30] Foreign Application Priority Data

| | | | |
|---|---|---|---|
| Oct. 2, 1986 | [JP] | Japan | 61-235263 |
| Feb. 3, 1987 | [JP] | Japan | 62-024179 |
| Jul. 29, 1987 | [JP] | Japan | 62-189884 |
| Jul. 29, 1987 | [JP] | Japan | 62-189883 |
| Jul. 29, 1987 | [JP] | Japan | 62-116433 |

[51] Int. Cl.[4] ..... F02M 25/06

[52] U.S. Cl. ..... 123/571; 364/431.06

[58] Field of Search ..... 123/568, 569, 570, 571; 364/431.06, 431.11; 60/278; 73/118.1

[56] References Cited

U.S. PATENT DOCUMENTS

| | | | |
|---|---|---|---|
| 4,163,282 | 7/1979 | Yamada et al. | 123/570 X |
| 4,433,666 | 2/1984 | Masaki et al. | 123/569 |
| 4,462,376 | 7/1984 | Ripper et al. | 123/569 X |
| 4,665,882 | 5/1987 | Otobe | 123/571 |
| 4,690,120 | 9/1987 | Egle | 123/571 |
| 4,715,348 | 12/1987 | Kobayashi et al. | 123/571 |
| 4,723,528 | 2/1988 | Tamura | 123/571 |
| 4,770,146 | 9/1988 | Shibata et al. | 123/571 X |
| 4,793,318 | 12/1988 | Tsurusaki | 123/571 |
| 4,794,903 | 1/1989 | Suzuki | 123/571 |

FOREIGN PATENT DOCUMENTS

| | | | |
|---|---|---|---|
| 2815109 | 11/1978 | Fed. Rep. of Germany | 123/571 |
| 0185857 | 10/1984 | Japan | 123/571 |

*Primary Examiner*—Willis R. Wolfe

*Attorney, Agent, or Firm*—Oliff & Berridge

[57] ABSTRACT

A diagnosis device for an exhaust gas recycling device diagnoses whether or not an exhaust gas recycling device is operating normally; the temperature of an exhaust gas recycling passage is detected by a temperature detection means, a decision is made by an exhaust gas recycling operating region detection means whether or not the operating region is such as to carry out exhaust gas recycling, when a decision is made that the operating region is such as to carry out exhaust gas recycling a counter is incremented and when otherwise is decremented, and a decision that the exhaust gas recycling is not being carried out normally, that is that the exhaust gas recycling device has failed, is made when the count value of this counter is at least a certain value and the temperature of the exhaust gas recycling passage is not more than a certain value.

6 Claims, 12 Drawing Sheets

DIAGNOSIS DEVICE FOR EXHAUST GAS RECYCLING DEVICE OF INTERNAL COMBUSTION ENGINE

BACKGROUND OF THE INVENTION

1. Field of the Invention

The present invention relates to a diagnosis device for determining whether or not an internal combustion engine exhaust gas recycling device used in a vehicle such as an automobile is functioning correctly.

2. Description of the Prior Art

Generally an exhaust gas recycling device to be incorporated in an internal combustion engine used in a vehicle such as an automobile incorporates an exhaust gas recycling control valve for controlling the recycling flow rate of the exhaust gas, a vacuum control valve for controlling the background pressure, a temperature sensing valve, and so forth, and if there is a fault in any of these structural components, the exhaust gas recycling will no longer be carried out and there is a danger of the internal combustion engine being operated in a state where the reduction in NOx in the exhaust gas is not carried out. Even if the exhaust gas recycling is not carried out because of a failure, the internal combustion engine will still operate without failing, and may therefore be driven for a long time without the driver realizing; this gives rise to atmospheric pollution problems.

In view of the above situation, a failure alarm device has already been proposed constructed such that when the exhaust gas recycling has stopped because of a failure of the exhaust gas recycling device the user is informed and given an opportunity for repair, and this is disclosed in for example Japanese Utility Model Publication Sho No. 52-9471 (1977) and in Japanese Utility Model Laying Open Publication Sho No. 62-71363 (1987).

Fault diagnosis of the exhaust gas recycling device may be carried out basically by, under conditions such that exhaust gas recycling should be carried out, determining whether or not, for example, the temperature within an exhaust gas recycling passage is at least a certain value, in other words by determining that when said temperature is not more than a certain value exhaust gas is not flowing in the exhaust gas recycling passage, and thus determining that the exhaust gas recycling device has failed, but the actual temperature of said exhaust gas recycling passage is altered by the repeated carrying out and stopping of exhaust gas recycling and therefore it is difficult to determine definitively whether or not exhaust gas is flowing through the exhaust gas recycling passage simply by the level of this temperature, and there is the problem that if diagnosis of the exhaust gas recycling device is carried out by simply determining the temperature of the exhaust gas recycling passage under conditions in which exhaust gas recycling is being carried out, then the diagnosis may not necessarily be correct.

The present invention has as its object the provision of an improved exhaust gas recycling device diagnosis device which solves the above problems.

SUMMARY OF THE INVENTION

The above object is achieved according to the present invention by a diagnosis device for an exhaust gas recycling device having: a temperature detecting means which detects the temperature of an exhaust gas recycling passage; an exhaust gas recycling operating region detection means which detects whether or not the operating region is such as to carry out exhaust gas recycling; a counter which is incremented when said exhaust gas recycling operating region detection means detects that the operating region is such as to carry out exhaust gas recycling, and is decremented when the operating region is determined not to be such as to carry out exhaust gas recycling; and a decision means which determines that the exhaust gas recycling has failed when the count value of said counter is at least a certain amount and the temperature detected by said temperature detection means is determined not to be more than a certain value.

The exhaust gas recycling operating region detection means may be such as, in principle, in other words when the exhaust gas recycling device is operating normally, to determine the operating region where exhaust gas recycling should be carried out from the intake air flow rate, the intake manifold pressure, or a combination of these with the engine rotation rate, or furthermore a combination of all of these with the engine coolant temperature, and to determine the detection items according to the exhaust gas recycling control characteristics.

According to the above construction, when the count value of the counter is at least a certain value, and if the exhaust gas recycling device is operating normally the temperature of the exhaust gas recycling passage will be definitely sufficiently high, and if at this time the temperature of the exhaust gas recycling passage is not more than a certain value then the exhaust gas recycling device is determined to have failed, and thereby an accurate diagnosis can be carried out.

The determination of the exhaust gas recycling passage temperature by said determination means may be carried out only after the count value of said counter has reached a certain value. Alternatively the diagnosis device according to the present invention may be constructed differently so that the counting of said counter is carried out only when the exhaust gas recycling passage temperature is not more than a certain value and when the count value of this counter reaches a certain value a failure diagnostic is produced.

In the exhaust gas recycling device diagnosis device according to the present invention, said counter may be constructed so that when it is determined to be the operating region for exhaust gas recycling by the exhaust gas recycling operating region detection means the count value is incremented until it reaches a predetermined maximum value, and when the count value reaches this maximum value it is maintained at the maximum value, and when it is determined not to be the operating region for carrying out exhaust gas recycling, the value is decremented.

In this case, a maximum value, or upper limit, for the count value of the counter is set, and then even if the vehicle is driven for a long time continuously in the exhaust gas recycling operating region, the count value is not increased above this maximum value, and therefore the count value is not increased indefinitely, in its relationship with the temperature of the exhaust gas recycling passage under normal operation the count value does not reach a large value totally unrelated to the temperature, and a false error determination is avoided. It should be noted that the reason that if the count value is increased without limit a large value completely removed from the exhaust gas recycling passage temperature is reached, is that even if the vehicle is driven continuously over a long period in the exhaust gas recycling operating region, the exhaust gas recycling passage temperature does not increase without limit, and the exhaust gas recycling passage temperature does not in fact become higher than the temperature of the exhaust gas flowing in the passage.

The diagnosis device for an exhaust gas recycling device according to the present invention may be provided with an increment prevention means which prevents said counter from incrementing until a certain time interval has elapsed from the time when the operating region of the internal combustion engine changes from an operating region which is not an exhaust gas recycling region to the exhaust gas recycling operating region.

In this case, the beginning of incrementing by the counter is delayed by the increment prevention means in a manner corresponding to the delay in the increase of the exhaust gas recycling passage temperature, and thus the count value of the counter represents reliably the exhaust gas recycling device, and therefore diagnosis of the exhaust gas recycling device can be carried out even more accurately without false failure diagnoses, according to the exhaust gas recycling passage temperature.

The increase in the exhaust gas recycling passage temperature is affected by the exhaust gas temperature, and the exhaust gas temperture in turn is higher when the exhaust gas flow rate is higher. Because of this, for a count value of the counter to represent more accurately the exhaust gas recycling passage temperature the increment amount may be determined depending on the exhaust gas flow rate.

In view of the above, in the diagnosis device for an exhaust gas recycling device according to the present invention, the increment amount of the counter for a certain time interval may be variably set according to the exhaust flow rate.

Thus the certain value of the continuous time interval for the exhaust gas recycling operating region, in other words the decision waiting time, is determing according to the exhaust gas flow rate, and thus a rapid and accurate failure determination can be made with always a reliable decision waiting time which is neither too short nor too long.

It should be noted that the exhaust gas flow rate is the same as the intake flow rate, and therefore detection of the exhaust gas flow rate may be substituted for by detection of the air intake flow rate.

BRIEF DESCRIPTION OF THE DRAWINGS

In the accompaning drawings:

FIG. 14 is a graph showing the increment amount characteristics of a counter in the diagnosis device according to the present invention.

DESCRIPTION OF THE PREFERRED EMBODIMENTS

The present invention is now described in detail with reference to the drawings in respect of embodiments.

Figure 1:
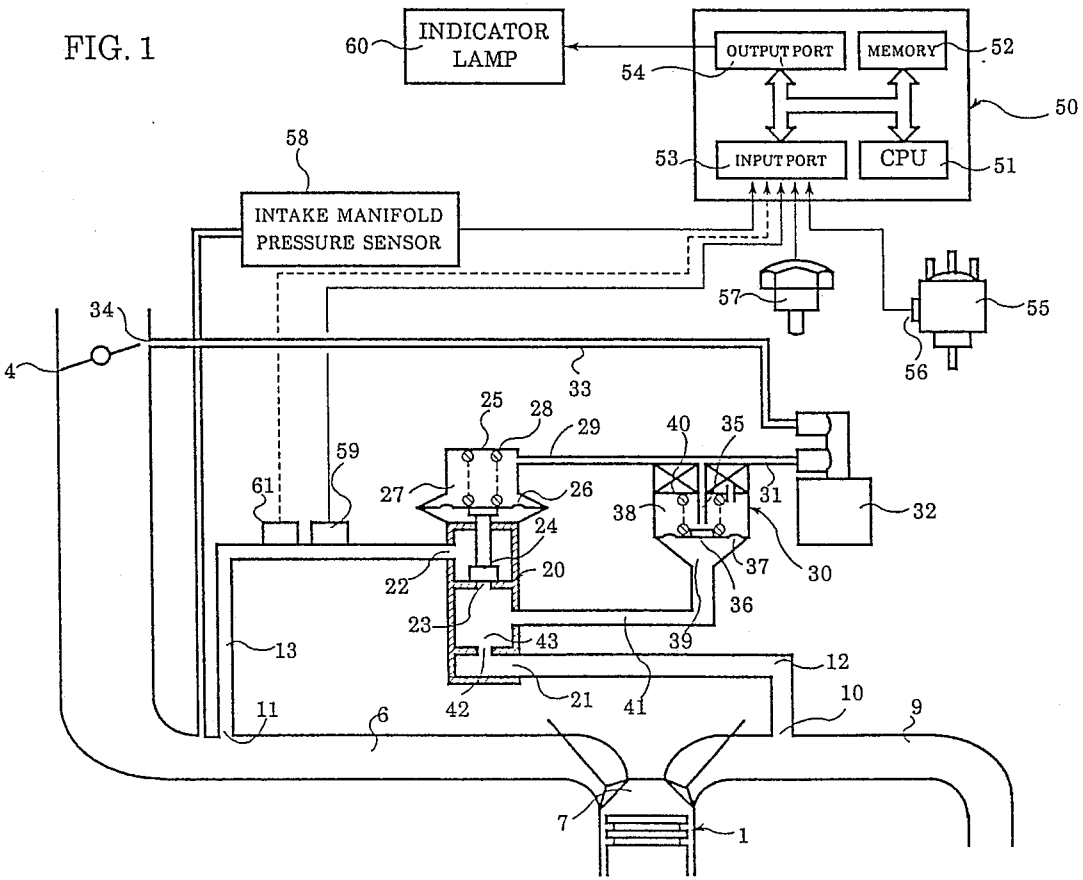
FIG. 1 is a schematic structural diagram of one embodiment of an exhaust gas recycling device provided with a diagnosis device according to the present invention.

FIG. 1 shows one embodiment of an exhaust recycling device in which is incorporated the diagnosis device according to the present invention. In FIG. 1, 1 indicates an internal combustion engine, and this internal combustion engine takes in mixture to a combustion chamber 7 through a throttle valve 4 and an intake manifold 6; the combustion products, in other words the exhaust gases, are expelled to an exhaust manifold 9.

The exhaust manidold 9 is provided with an exhaust gas take-in port 10 for exhaust gas recycling, and the inlet manifold 6 is provided with an exhaust gas introduction port 11; the exhaust gas take-in port 10 and the exhaust gas introduction port 11 are connectec by an exhaust gas recycling line 12, an exhaust gas recycling control valve 20, and a line 13, in series.

The exhaust gas recycling control valve 20 is provided with an inlet port 21 and an outlet port 22; the inlet port 21 is connected by the line 12 to the exhaust gas take-in port 10, and the outlet port 22 is connected by the line 13 to the exhaust gas introduction port 11. The exhaust gas recycling control valve 20 is provided with a valve port 23 and a valve element 24; the valve port 23 is opened and closed by the valve element 24 and the opening is controlled so that the flow rate of exhaust gas recycling is controlled. The valve element 24 is connected to a diaphragm 26 of a diaphragm device 25, and when a negative pressure exceeding a certain value, for example -70 mmHg, is not present within a diaphragm chamber 27, it is urged downwards by the spring force of a compression coil spring 28 and closes the valve port 23; when a negative pressure exceeding the certain value is introduced into the diaphragm chamber 27, then this negative pressure overcomes the spring force of the compression coil spring 28 and its rises to open the valve port 23.

The diaphragm chamber 27 of the exhaust gas recycling control valve 20 is connected by a line 29, a negative pressure control valve 30 for background pressure control, a line 31, a temperature sensitive valve 32, and a line 33 to an inlet manifold negative pressure take-out port 34. The inlet manifold negative pressure take-out port 34 is, as shown in the diagram, provided in such a position as to be upstream of the throttle valve 4 when in the fully closed position, but downstream of the throttle valve 4 when it is opened more than a relatively small amount.

The negative pressure control valve 30 has a valve element 36 which opens and closes a valve port 35, and a diaphragm 37 which supports this valve element, and the diaphragm 37 delineates an atmospheric chamber 38 which is open to the atmosphere on the upper side in the drawing, and a diaphragm chamber 39 on the lower side in the drawing; when a pressure (positive pressure) of at least a certain value is not present in the diaphragm chamber 39 the diaphragm pulls the valve element 36 away from the valve port 35 under the effect of the compression coil spring 40, and is in the position to open this valve port, whereas when the pressure of at least a certain value is introduced in to the diaphragm chamber 39, the force of the compression coil spring 40 is overcome, the diaphragm moves upwards in the drawing, and the valve element 36 is held against the valve port 35 so that the position is such as to close the valve port.

The diaphragm chamber 39 of the negative pressure control valve 30 is connected by a line 41 to a pressure chamber 43 between the valve port 23 of the exhaust gas recycling control valve 20 and an orifice 42 provided downstream thereof, and thus has the exhaust gas pressure within the pressure chamber admitted to it.

The contruction thus described of the negative pressure control valve 30 and the orifice 42 is a well known background pressure control construction, and in the exhaust gas recycling operating range in which the inlet manifold negative pressure is applied to the exhaust gas recycling control valve 20 the negative pressure supplied to the diaphragm chamber 27 of the exhaust gas recycling control valve 20 is adjusted so as to maintain at a substantially constant value the exhaust gas pressure in the pressure chamber 43, or in other words the opening of the valve port 23 is adjusted, and thereby the ratio of the exhaust gas recycling flow rate to the intake air flow rate, or in other words the EGR ratio, is maintained at a substantially constant value.

The temperature sensitive valve 32 responds to the coolant temperature of the internal combustion engine 1, and when the engine is warming up and the coolant temperature is not more than a certain value, for example 60 degrees C, then the valve is closed and the connection between the lines 31 and 33 is shut-off; on the other hand when the coolant temperature is at least a certain temperature a connection between the lines 31 and 33 is established.

According to the above construction, the exhaust gas recycling control valve 20 is opened when a negative pressure exceeding a certain value, for example −70 mmHg, is supplied to the line 29, and the coolant temperature of the internal combustion engine 1 is at least a certain value, for example 60 degrees C, so that the temperature sensitive valve 32 is open; the exhaust gas recycling is carried out with a flow rate corresponding to this degree of opening.

In the drawings, 50 indicates a microcomputer which carries out the diagnosis of the exhaust gas recycling device. The microcomputer 50 is of an ordinary construction, and has a central processing unit (CPU) 51, a memory 52, an input port 53, and an output port 54; it receives information relating to the revolution rate of the internal combustion engine 1 from a revolution rate sensor 56 provided on a distributor 55 of the internal combustion engine 1, information relating to the coolant temperature of the internal combustion engine 1 from a coolant temperature sensor 57, information relating to the intake manifold pressure from an intake manifold pressure sensor 58, and information relating to the temperature in the line 13 from a temperature sensitive switch 59 provided at an intermediate point of the exhaust gas recycling line 13; based on this information, a diagnosis is made as to whether or not the exhaust gas recycling device is operating normally, according to the flowchart shown in FIG. 2, and when a decision is made that the exhaust gas recycling device is not operating normally, an indicator lamp 60 is illuminated.

The operation of the diagnosis device according to the present invention is not described with reference to the flowchart shown in FIG. 2.

Figure 2:
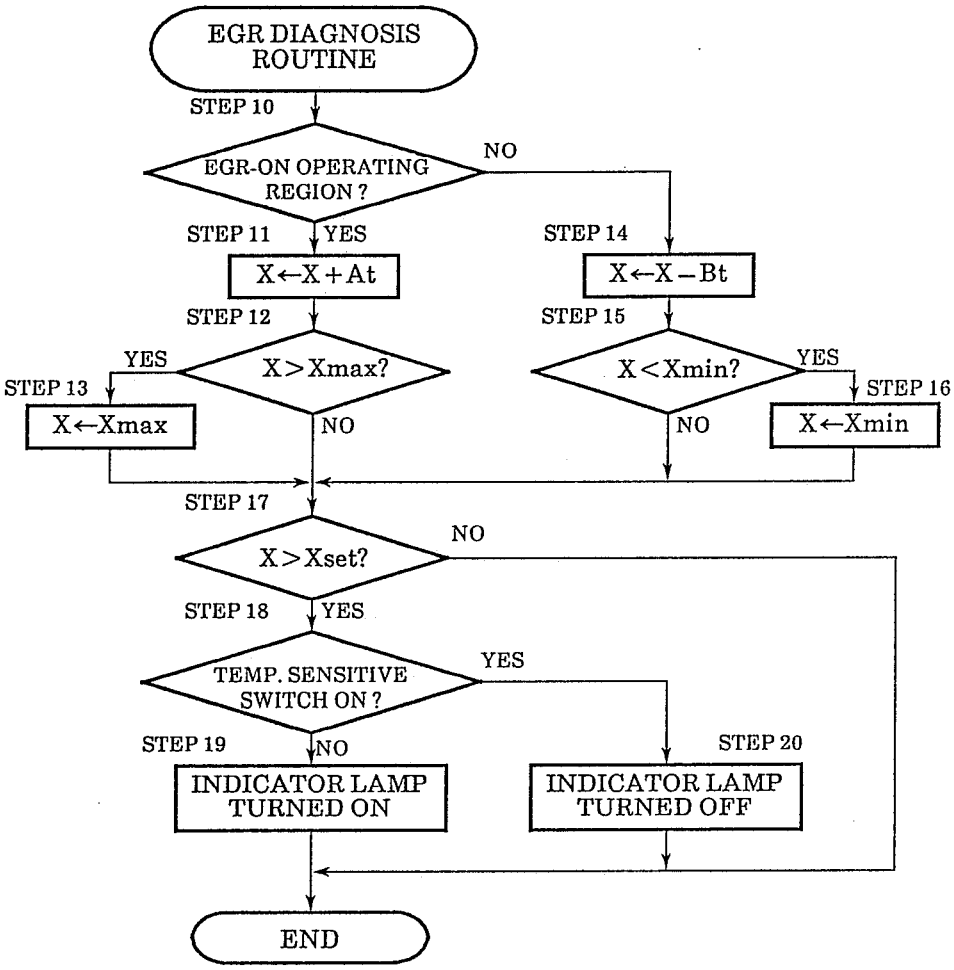
FIG. 2 is a flowchart showing the basic operation of the diagnosis device according to the present invention.

The EGR diagnosis routine shown in FIG. 2 is executed as an interrupt routine at a certain time interval, and in the first step 10 a test is made as to whether or not it is the exhaust gas recycling operating region, or in other words the EGR-on operating region. This is a test as to whether or not the driving conditions under which exhaust gas recycling is carried out apply, and in this embodiment the decision may be based on the rotation rate of the internal combustion engine 1 determined by the rotation rate sensor 56, the coolant temperature of the internal combustion engine 1 determined by the coolant temperature sensor 57, and the intake manifold pressure determined by the intake manifold pressure sensor 58. When in the EGR-on operating region control proceeds to step 11, and when not in the EGR-on operating region control proceeds to step 14.

In step 11 the count value X of a counter in the CPU 51 is incremented by an amount At. A is the rate of increase of temperature of the line when exhaust gas flows through an exhaust gas recycling line 10, and t is a time term. Thereby, in the EGR-on operating region, as time passes the count value X of the counter is increased with a certain temperature increase rate A. After step 11 control proceeds to step 12.

In step 12, a test is made as to whether or not the count value X of the counter is larger than a predetermined maximum value Xmax. If $X > Xmax$ control goes to step 13, whereas if it is not true that $X > Xmax$ control goes to step 17.

In step 13, the count value X of the counter is maintained at its maximum value Xmax. After step 13 control goes to step 17.

In step 14 the count value X of a counter in the CPU 51 is decremented by an amount Bt. B is the rate of decrease of temperature of the line when exhaust gas flows through an exhaust gas recycling line 10, and t is a time term. Therefore, if not in the EGR-on operating region, as time passes the count value X of the counter is decreased with a certain temperature decrease rate B. After step 14 control proceeds to step 15.

In step 15, a test is made as to whether or not the count value X of the counter is less than a predetermined minimum value Xmin. If $X < Xmin$ control goes to step 16, whereas if it is not true that $X < Xmin$ control goes to step 17.

In step 16, the count value X of the counter is maintained at its minimum value Xmin, for example 0. After step 16 control goes to step 17.

By incrementing or decrementing the count value X of the counter according to whether or not the EGR-on operating conditions apply as described above, as shown in FIG. 3 this count value X approximates to the fluctuations in the actual temperature in the exhaust gas recycling line 13, and thus is an approximate representation of that actual temperature.

In step 17, a test is made as to whether or not the count value X of the counter is greater than a predetermined certain value Xset. The certain value Xset is set to be a value corresponding to a temperature sufficiently higher than the setting temperature TSWset of the temperature sensitive switch 59, and when X>Xset, if the exhaust gas recycling device is operating normally the temperature sensitive switch 59 should already be definitely in the on state, and at this point control goes to step 18.

In step 18, a test is made as to whether or not the temperature sensitive switch 59 is in the on state. At this point, if the temperature sensitive switch 59 is not in the on state the exhaust gas recycling device has failed and control goes to step 19, whereas if the temperature sensitive switch 59 is in the on state then the exhaust gas recycling device is operating normally, and control goes to step 20.

In step 19, because of the failure determination result, the indicator lamp 60 is turned on. Turning on this indicator lamp 60 enables the user to be aware that a failure of the exhaust gas recycling device has occurred.

In step 20, because of the normal operation determination result, the indicator lamp 60 is turned off or is not turned on. At this point the exhaust gas recycling device is operating normally.

By carrying out diagnosis of the exhaust gas recycling device according to the flowchart described above, an accurate diagnosis can be carried out without false decisions from a simple temperature determination of the exhaust gas recycling line, irrespective of the complicated temperature fluctuations of the exhaust gas recycling line which occur with the turning on and off of exhaust gas recycling.

Next the operation of another embodiment of the diagnosis device according to the present invention is described with reference to the flowchart shown in FIG. 4. It should be noted that in this embodiment the temperature sensitive switch 59 is replaced by a temperature sensor 61 which detects the temperature of the EGR line 12.

Figure 4:
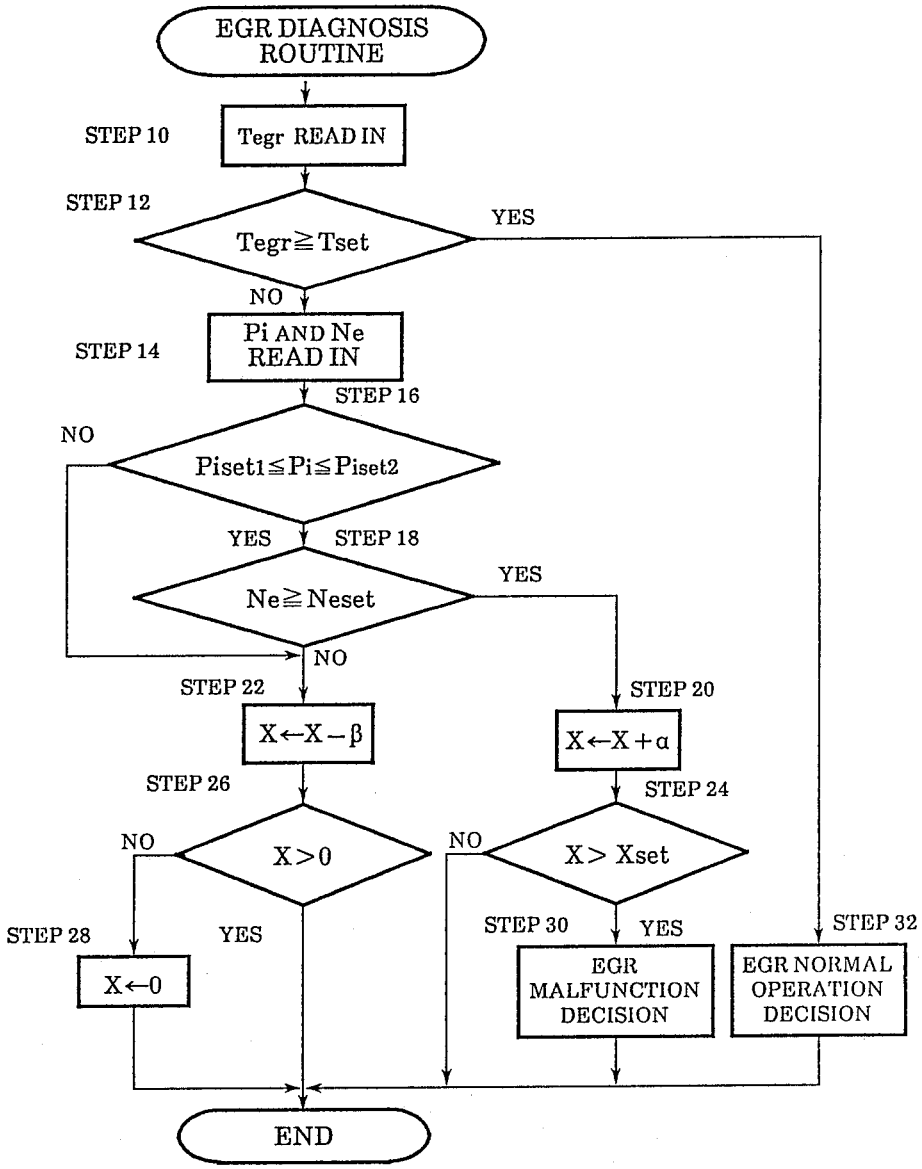
FIG. 4 is a flowchart showing the operation of another embodiment of the diagnosis device according to the present invention.

The EGR diagnosis routine shown in FIG. 4 is executed as an interrupt routine at a certain time interval, and in the first step 10 the exhaust gas recycling passage temperature Tegr is read in from the temperature sensor 61, and then control goes to step 12.

In step 12, a decision is made as to whether or not the exhaust gas recycling passage temperature Tegr detected by the temperature sensor 61 is higher than a decision temperature Tset. When Tegr is at least Tset, then exhaust gas recycling is being carried out, and at this time the situation is regarded as normal and control goes to step 32, whereas when Tegr is not at least Tset exhaust gas recycling is not being carried out and at this time control goes to step 14.

In step 14, the intake manifold pressure Pi is read in from the intake manifold pressure sensor 58, and the engine revolution rate Ne is read in from the revolution rate sensor 56; next control goes to step 16.

In step 16, a test is made as to whether or not the intake manifold pressure Pi detected by the intake manifold pressure sensor 58 is at least Piset1 and not more than a value Piset2 greater than Piset1. When Piset1 ≦/=Pi≦/=Piset2, control goes to step 18, whereas when that is not the case control goes to step 22.

In step 18, a test is made as to whether or not the rotation rate Ne of the internal combustion engine 1 detected by the rotation rate sensor 58 is at least a certain predetermined value Neset, which is for example 1600 rpm. When N≧/=Neset, control goes to step 20, whereas when it is not the case that Ne≧/=Neset, control goes to step 22.

In step 20, the count value X of the counter is incremented by a certain value alpha, and then control goes to step 24.

In step 22, the count value X of the counter is decremented by a certain value beat, and then control goes to step 26.

In step 24, a test is made as to whether or not the count value X of the counter has reached a certain value Xset. The value Xset is set according to the desired diagnosis sensitivity, and when X>Xset control goes to step 30.

In step 26, a test is made as to whether or not the count value X of the counter is at least 0. When it is not the case that X>0, control goes to step 28, and in step 28 the count value X is set to 0.

In step 30, the malfunction decision causes the indicator lamp 60 to be turned on. Turning on the indicator lamp 60 allows the user to be made aware that there is a failure in the exhaust gas recycling device.

In step 32, the normal decision means that the indicator lamp 60 is turned off, or is not turned on. At this point the exhaust gas recycling device is operating normally.

Figure 5:
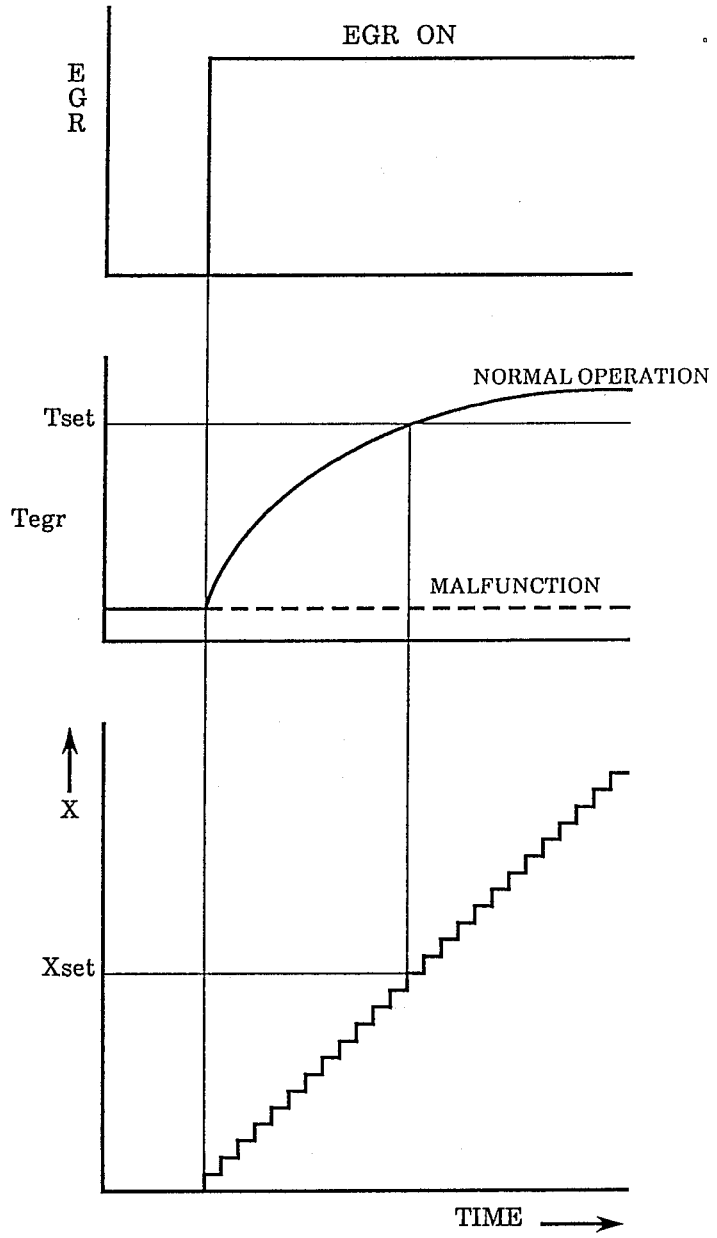
FIG. 5 and FIG. 6 are graphs showing in detail the relationship between the count value of the counter and the exhaust gas recycling passage wall temperature due to the exhaust gas recycling.
Figure 6:
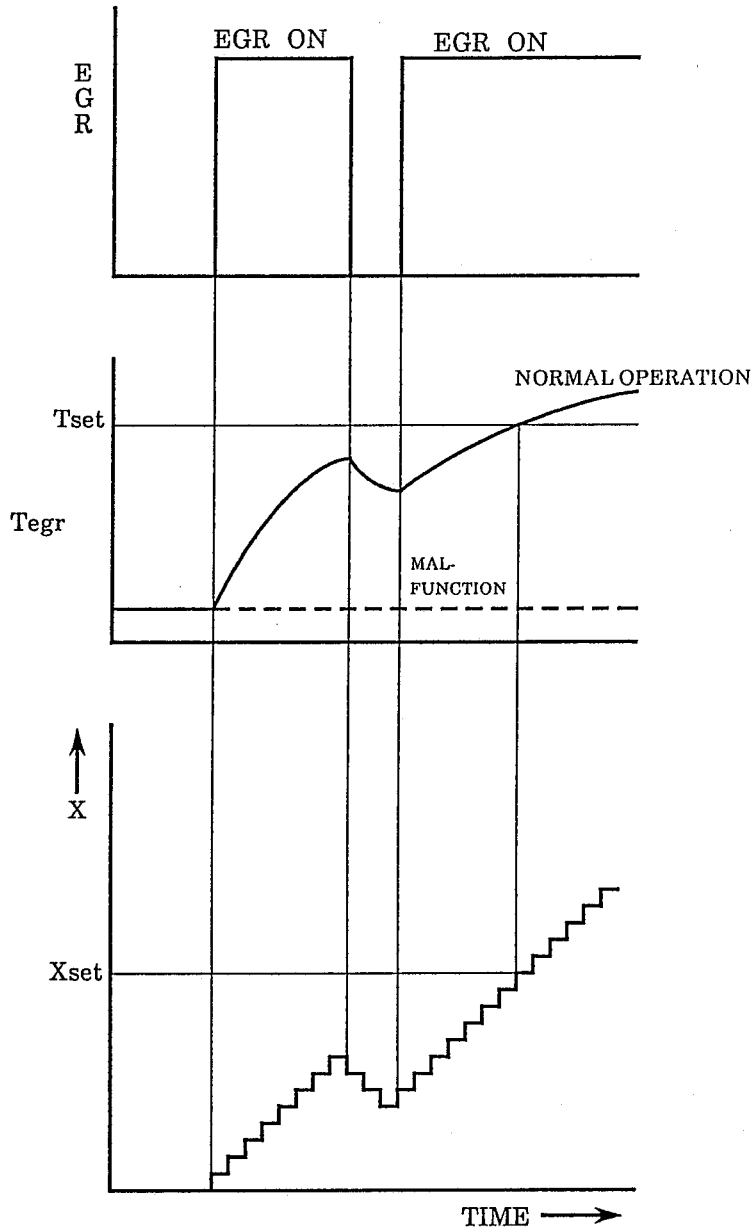

FIG. 5 and FIG. 6 show the relationship between the count value X of the counter and the wall surface temperature of the exhaust gas recycling line 13 due to the exhaust gas recycling. FIG. 5 shows a case in which exhaust gas recycling has been carried out continuously for at least the certain time interval, and the count value X of the counter has simply been incremented, and FIG. 6 illustrates a case in which exhaust gas recycling has been turned on and off repeatedly and the count value X of the counter has fluctuated both up and down.

By carrying out diagnosis of the exhaust gas recycling device according to the flowchart as described above, regardless of the complicated temperature fluctuations of the exhaust gas recycling line with the turning on and off of exhaust gas recycling, from a simple temperature decision of the exhaust gas recycling line a reliable diagnosis can be carried out without errors.

Figure 7:
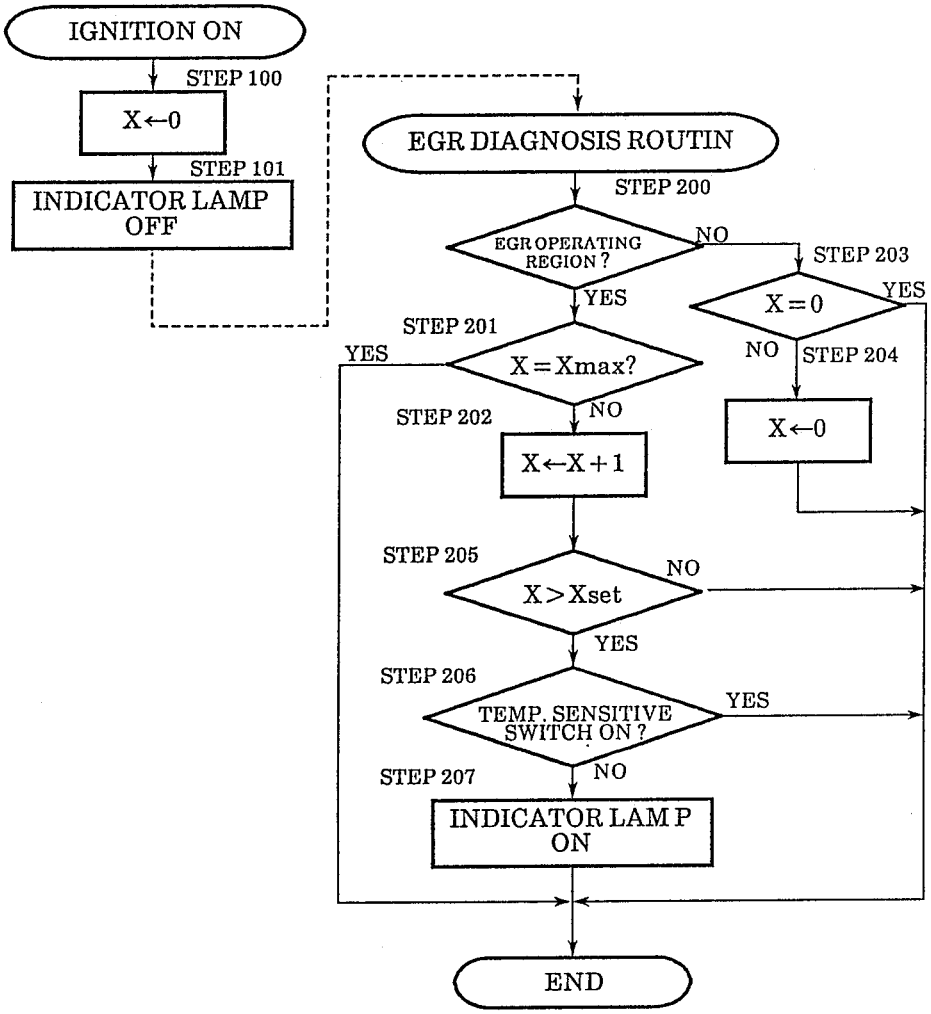
FIG. 7 is a flowchart showing another example of the operation of the diagnosis device according to the present invention.

Next another example of operation of the diagnosis device according to the present invention is described with reference to the flowchart shown in FIG. 7.

When the ignition switch of the internal combustion engine 1 is turned on, first in step 100 the count value X of the counter is cleared. Then in step 101 the indicator lamp 60 is turned off. These steps 100 and 101 are only carried out when the ignition switch goes from the off state to the on state, or in other words when starting the engine, and thereafter are not carried out until the engine is started again.

The exhaust gas recycling diagnosis routine begins at step 200. This routine may be executed as an interrupt routine repeated at a certain time interval such as for example every 240 ms.

In step 200, a test is made as to whether or not the operating region of the internal combustion engine 1 currently in the EGR-on operating region. This decision is whether or not the driving conditions under which exhaust gas recycling is carried out apply, and in this embodiment also this decision may be carried out depending on the rotation rate of the internal combustion engine 1 detected by the rotation rate sensor 56, the coolant temperature of the internal combustion engine 1 detected by the coolant temperature sensor 57, and the inlet manifold pressure detected by the inlet manifold pressure sensor 58, and so forth. When in the EGR-on operating region control goes to step 201 whereas when not in the EGR-on operating region control goes to step 203.

In step 201, a test is made as to whether or not the count value X of the counter is a predetermined maximum value Xmax. When X=Xmax the EGR diagnosis routine is terminated, whereas when it is not true that X=Xmax then control goes to step 202.

In step 202, the count value X of the counter is incremented by 1. This causes the count value X of the counter to be increased with the passage of time in the EGR-on operating region, and therefore the count value X represents the driving time in the EGR-on operating region. It should be noted that because of step 201 the count value X is not increased higher than the minimum value Xmax. After step 202 control goes to step 205.

In step 203, a test is made as to whether the count value X is 0. When it is the case that X=0, the EGR diagnosis routine is terminated, whereas when it is not the case that X=0 control goes to step 204.

In step 204, the count value X of the counter is reset immediately to 0. Therefore when outside the EGR-on operating region the count value X of the counter is 0.

In step 205 a test is made as to whether or not the count value X of the counter is greater than a predetermined value Xset. The value Xset is determined to be a value corresponding to a temperaature adequately higher than the setting temperature of the temperature switch 59, and when X>Xset, if the exhaust gas recycling device is operating normally the temperature sensitive switch 59 will definitely have already been turned on, and in that case control goes to step 206.

In step 206, a test is made as to whether or not the temperature sensitive switch 59 is on. At this point, if the temperature sensitive switch 59 is not on then the exhaust gas recycling device has failed, and control goes to step 207, whereas is the temperature sensitive switch 59 is on then the exhaust gas recycling device is operating normally, and the EGR diagnosis routine is terminated.

In step 207 the indicator lamp 60 is turned on. Turning on this indicator lamp 60 allows the user to be made aware that a fault has occurred in the exhaust gas recycling device.

Figure 8:
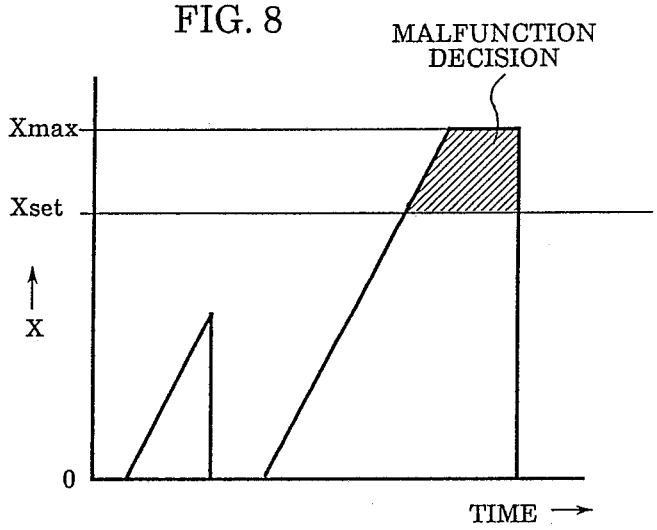
FIG. 8 is a graph showing the time progression changes of the counter count in the operation example shown in FIG. 7.

In this case, EGR diagnosis is only carried out from a temperature determination when driving has continued in the EGR-on operating region continuously for the time interval determined by the certain value Xset of the counter, and compared with the embodiment of FIG. 2 the opportunities for temperature determination for EGR diagnosis are fewer, but a false diagnosis of EGR failure is even more positively prevented from occurring. It should be noted that in this case the change with time of the count value X of the counter is as shown in FIG. 8.

Figure 10:
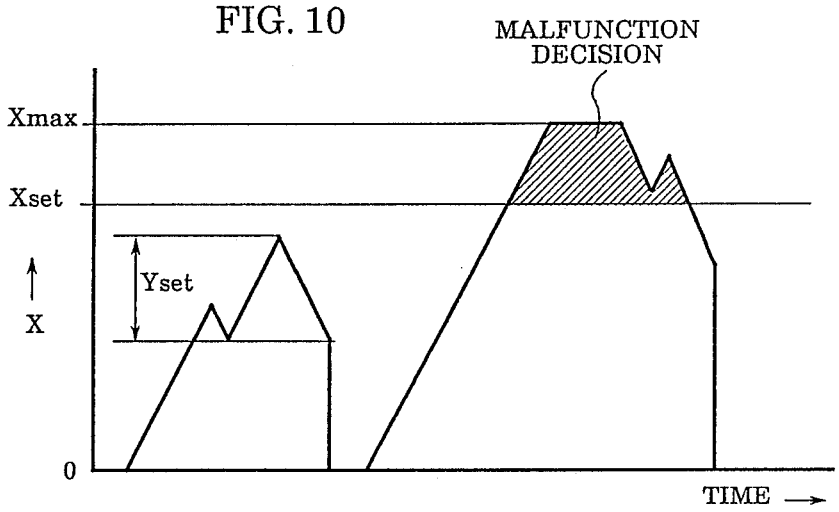
FIG. 10 is a graph showing the time progression changes of the counter count value in the operation example shown in FIG. 9.
Figure 1:
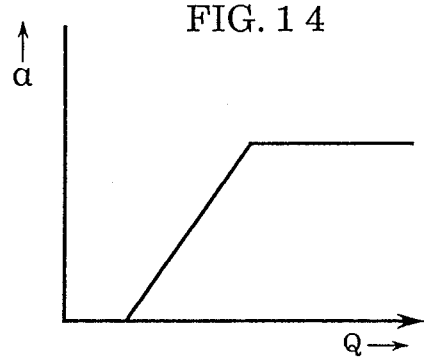
Figure 9:
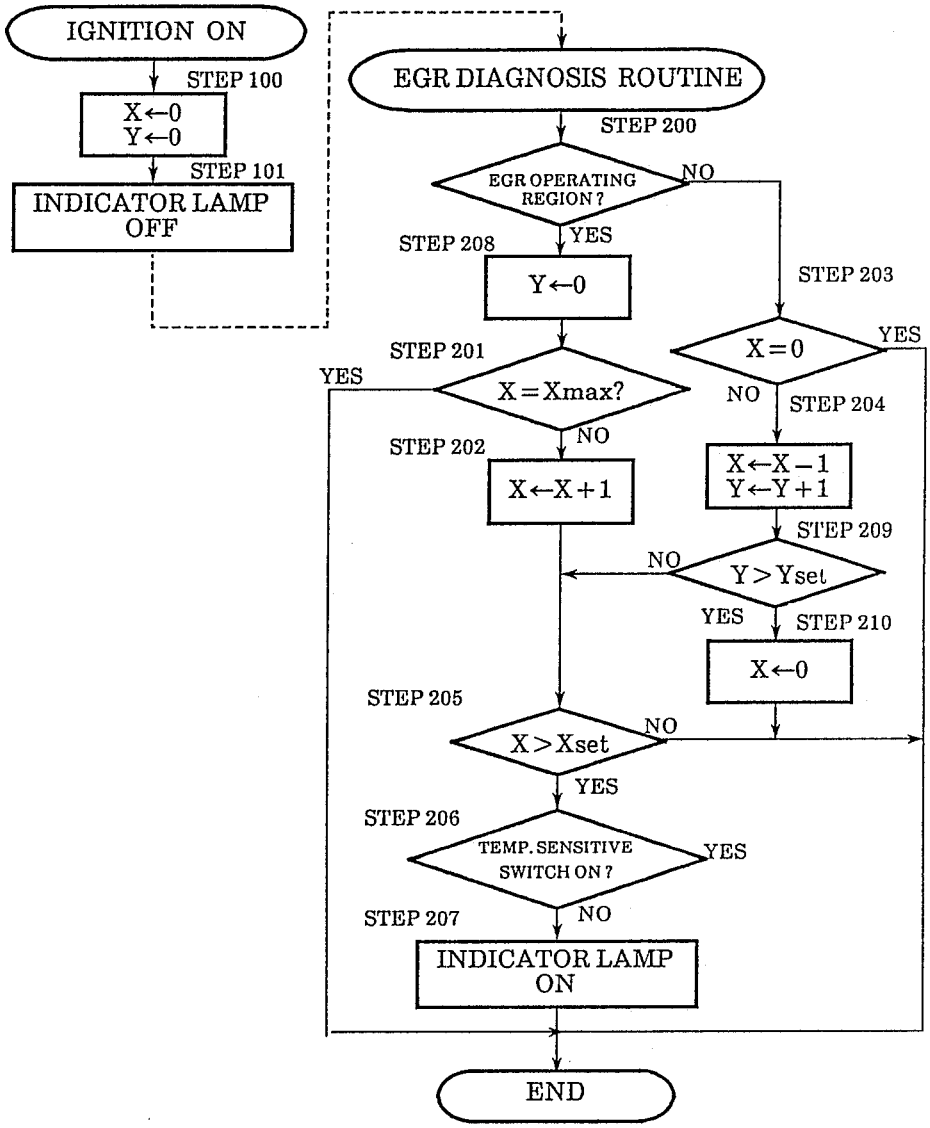
FIG. 9 is a flowchart showing another example of operation of the diagnosis device according to the present invention.

Again, the reduction control of the count value X of the counter when not in the EGR-on operating region may be as shown in FIG. 9, where while driving in an operating region not the EGR-on operating region is carried out continuously, the count value Y of another counter is also counted, and until this count value Y reaches a predetermined set value Yset the count value X is decremented by 1 each time, and when this count value Y reaches the certain value Yset the count value X is immediately set to 0. In this case, if driving continues in an operating region outside the EGR-on operating region for at least a certain time interval the count value X is reset to 0, and control characteristics intermediate between those of the embodiment of FIG. 2 and the embodiment of FIG. 7 are obtained. It should be noted that in this embodiment the fluctuations with time of the count value X of the counter are as shown in FIG. 10.

Figure 11:
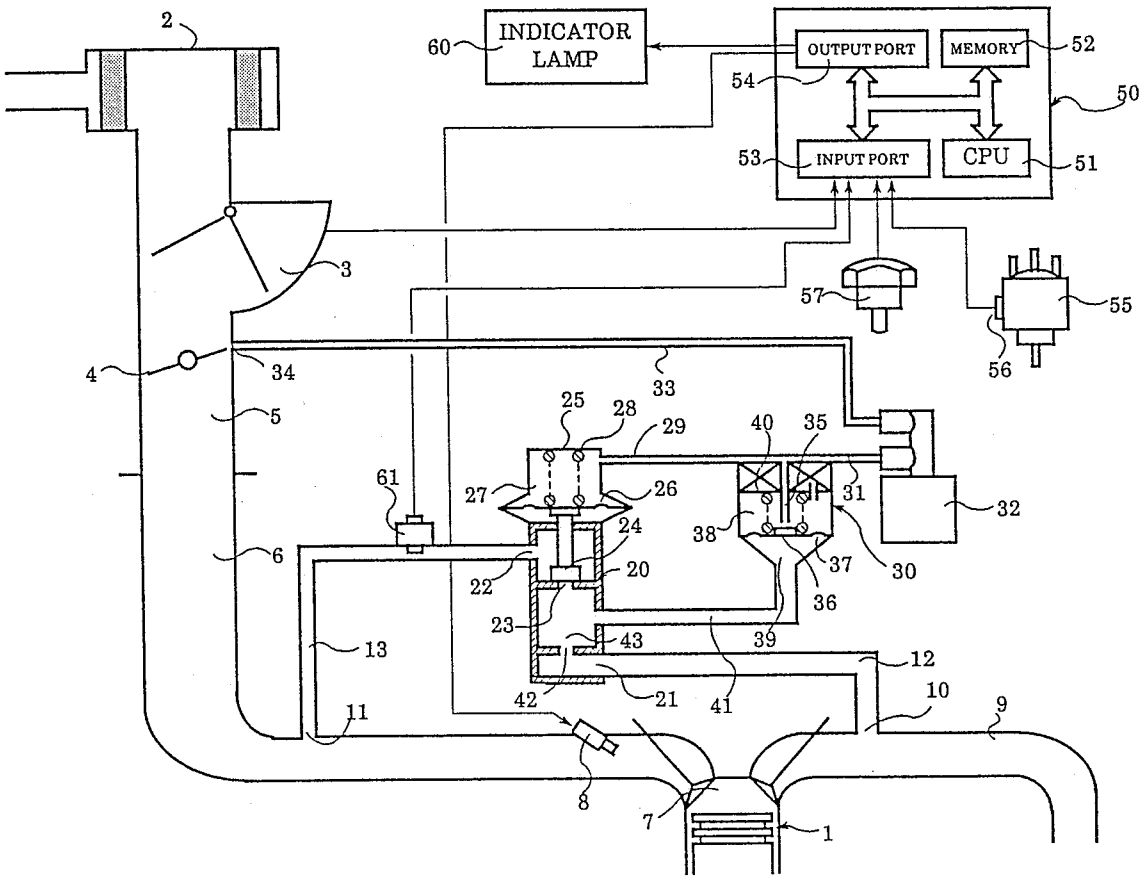
FIG. 11 is a schematic structural diagram of another embodiment of an exhaust gas recycling device incorporating a diagnosis device according to the present invention.

FIG. 11 shows another embodiment of an exhaust gas recycling device incorporating the diagnosis device according to the present invention. In FIG. 11 is should be noted that portions corresponding to portions in FIG. 1 have the same reference numerals as in FIG. 1. In FIG. 11, 1 is an internal combustion engine, and this internal combustion engine takes in air through an air cleaner 2, an air flow meter 3, an intake passage 5 having a throttle valve 4, and an intake manifold 6, to a combustion chamber 7; the engine has fuel injected through a fuel injector 8, and combustion products, in other words exhaust gases, are ejected through an exhaust manifold 9.

Figure 12:
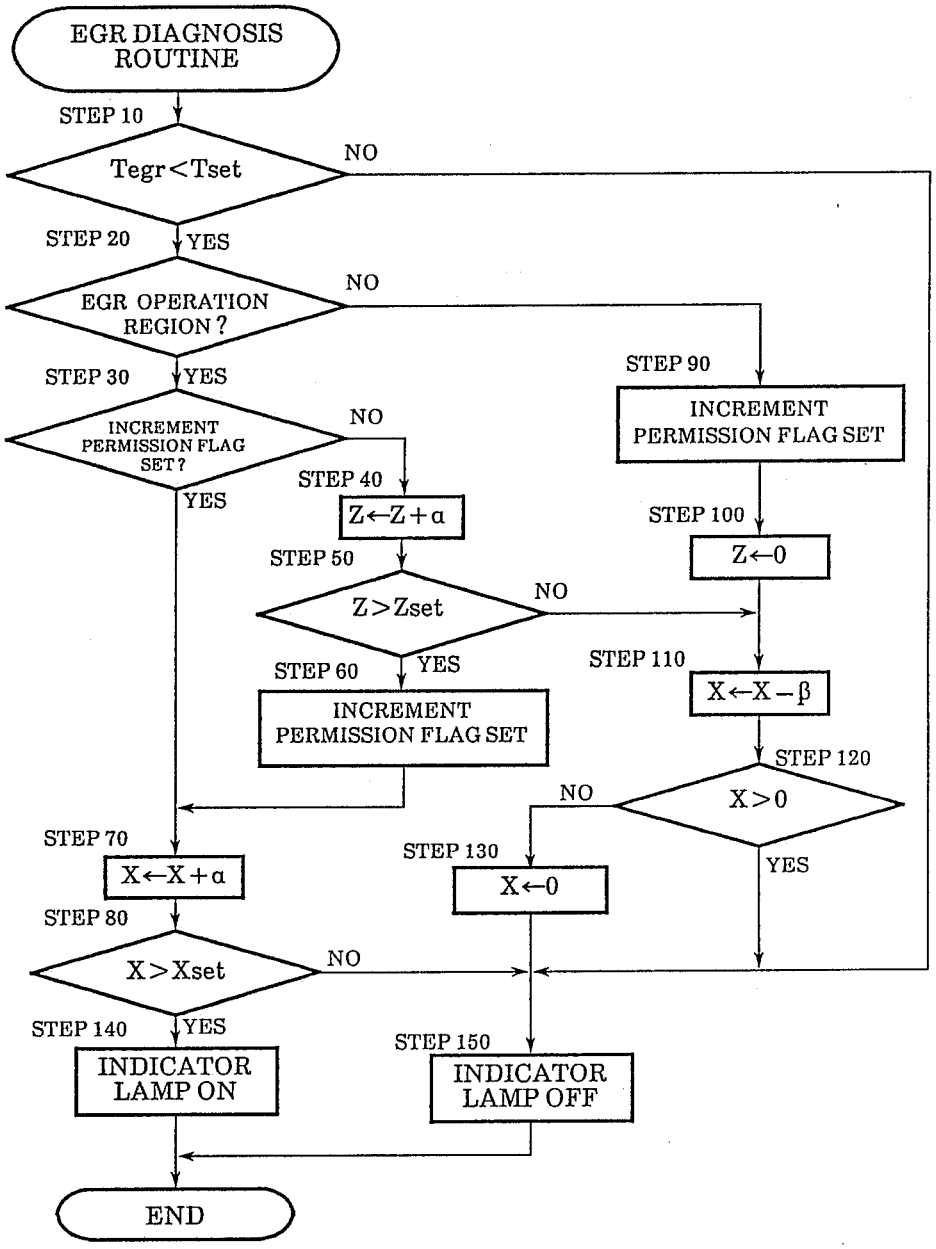
FIG. 12 is a flowchart showing the operation of the diagnosis device according to the present invention shown in FIG. 11.

The microcomputer 50 is of an ordinary construction, and has a central processing unit (CPU) 51, a memory 52, an input port 53, and an output port 54; data relating to the rotation rate of the internal combustion engine 1 from a rotation rate sensor 56 provided in a distributor 55 of the internal combution engine 1, data relating to the temperature of a coolant of the internal combustion engine 1 from a coolant sensor 57, data relating to the intake air flow rate from the air flow meter 3, and data relating to the temperature of the line 10 from a temperature sensor 61 provided at an intermediate point of the exhaust gas recycling line 13 are supplied to the microcomputer, and based on these data fuel injection by the fuel injector 8 is controlled, and following a flowchart as shown in FIG. 12 a diagnosis is made as to whether or not exhaust gas recycling device is operating normally, and when a decision is made that exhaust gas recycling device is not operating normally an indicator lamp 60 is turned on.

Next the operation of the diagnosis device according to the present invention is described with reference to the flowchart shown in FIG. 12. The routine shown in FIG. 12 is an interrrupt routine repeated at a certain time interval such as for example 240 ms.

First in step 10, a test is made as to whether or not the temperature of the line 13 detected by the temperature sensor 59, in other words the exhaust gas recycling passage temperature Tegr is not more than a predetermined set value Tset. When Tegr<Tset, control goes to step 20, and otherwise, in other words when the exhaust gas recycling passage temperature is at least the certain value, control goes to step 150.

In step 20 a test is made as to whether or not the current operating region of the internal combustion engine is in the exhaust gas recycling operating region. The decision as to whether or not it is the exhaust gas recycling operation region may be carried out according to the intake air flow rate detected by the air flow meter 3, the revolution rate of the internal combustion engine 1 detected by the revolution rate sensor 56, and the coolant temperature of the internal combustion engine 1 detected by the coolant temperature sensor 57, and when in the exhaust gas recycling operating region control goes to step 30, whereas otherwise control goes to step 90.

In step 30 a test is made as to whether or not an increment permission flag is set. If the increment permission flag is set control goes to step 70, whereas otherwise control goes to step 40.

In step 40 the count value Z of the counter is incremented by an amount alpha. After step 40, control goes to step 50.

In step 50, a test is made as to whether or not the count value Z of the counter is at least a predetermined set value Zset. When Z>Zset control goes to step 60, whereas otherwise control goes to step 110.

The set value Zset may be a predetermined fixed value, or may be set each time the engine is started depending on the intake air temperature, ambient temperature, coolant temperature, exhaust gas recycling passage temperature and so forth, or may be set each time the exhaust gas recycling operating region is newly detected.

In step 60, the increment permission flag is set. After step 60 control goes to step 70.

In step 70, the count value X of another counter is incremented by an amount alpha. After step 70 control goes to step 80.

In step 80, a test is made as to whether or not the count value X of the counter is at least a predetermined set value Xset. When X>Xset control goes to step 140, whereas otherwise control goes to step 150.

Step 90 is executed when the operating region of the internal combustion engine 1 is not currently the exhaust gas recycling operating region, and in step 90 the increment position flag is reset. After step 90 control goes to step 100.

In step 100, the count value Z of the counter is reset to 0. After step 100 control goes to step 110.

In step 110 the count value X of another counter is decremented by an amount beta. After step 110 control goes to step 120.

In step 120, a test is made as to whether or not the count value X of the counter is greater than 0. When X>0 control goes to step 150, whereas otherwise control goes to step 130.

In step 130, the count value X of the counter is set to 0. After step 130 control goes to step 150.

In step 140, a decision is made that the exhaust gas recycling device has failed, and the indicator lamp 60 is turned on.

In step 150, a decision is made that the exhaust gas recycling device has not failed, and the indicator lamp 60 is turned off.

By carrying out diagnosis of the exhaust gas recycling device according to the above described flowchart, even when the operating region of the internal combustion engine goes into the exhaust gas recycling operating region, the count value X of the counter is incremented with a delay determined by the certain value Zset of the count value Z, and thereby the manner of incrementing the count value X matches the rising characteristics of the exhaust gas recycling passage temperature Te detected by the temperature sensor 59, and therefore the decision that the exhaust gas recycling device has failed is made from the exhaust gas recycling passage temperature when the count value X is at least a certain value Xset, and the diagnosis is made even more reliable.

Figure 13:
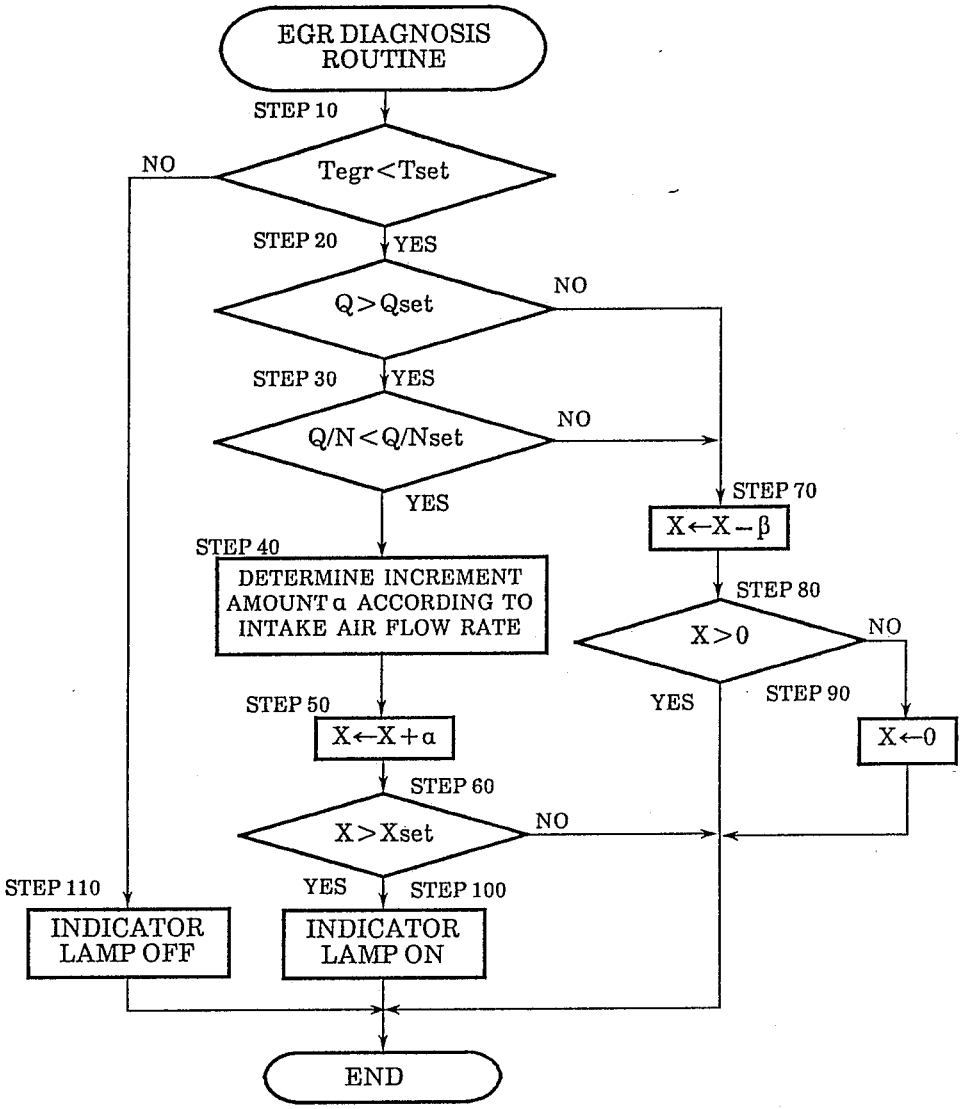
FIG. 13 is a flowchart showing another example of the operation of the diagnosis device according to the present invention.

FIG. 13 shows another embodiment of the diagnosis device according to the present invention.

Figure 3:
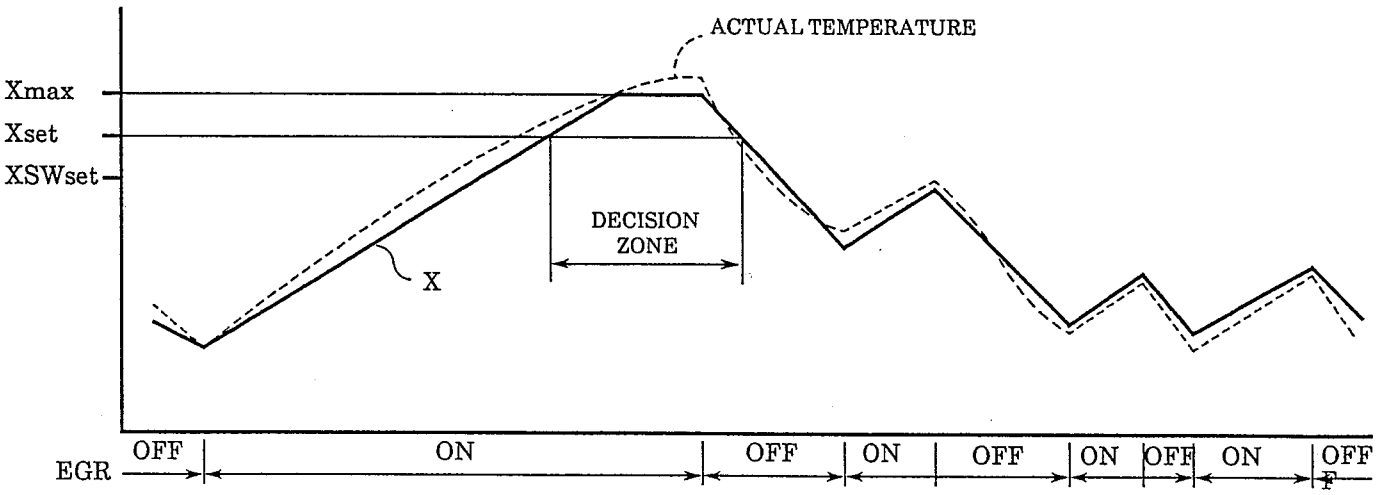
FIG. 3 is a timing chart showing the basic operation of the diagnosis device according to the present invention.

The routine shown in FIG. 3 is an interrupt routine executed repeatedly at a certain time interval such as for example 240 mns.

First in step 10, a test is made as to whether or not the temperature of the line 13 detected by the temperature sensor 59, in other words the exhaust gas recycling passage temperature Tegr is not more than a predetermined set value Tset. When Tegr<Tset, control goes to step 20, and otherwise, in other words when the exhaust gas recycling passage temperature is at least the certain value, control goes to step 110.

In step 20, a test is made as to whether or not the intake air flow rate Q detected by the air flow meter 3 is at least a certain value (lower bound) Qset. When Q>Qset, control goes to step 30 and otherwise control goes to step 70.

In step 30, the ratio Q/N of the intake air flow rate for a single stroke of the engine is computed from the intake air flow rate Q detected by the air flow meter 3 and the revolution rate N of the internal combustion engine 1 detected by the revolution rate sensor 56, and a test is made as to whether or not the ratio Q/N of the intake air flow rate for one stroke of the engine is not more than a certain value (upper limit) Q/Nset. When Q/N<Q/Nset, a decision is made that it is the exhaust gas recycling operating region, and in this case control goes to step 40, whereas otherwise control goes to step 70.

In step 40, an increment amount alpha is determined according to the intake air flow rate Q detected by the air flow meter 3. The increment amount alpha is set as shown for example in FIG. 14 to increase with an increase in the intake air flow rate Q detected by the air flow meter 3, so as to be set to a larger value when the exhaust gas flow rate exhausted by the internal combustion engine 1 is larger. After step 40, control goes to step 50.

In step 50, the count value X of the counter is incremented by the increment amount alpha determined in step 40. After step 50 control goes to step 60.

In step 60, a test is made as to whether or not the count value X of the counter is at least a predetermined set value Xset. When X>Xset, control goes to step 100, whereas otherwise control returns.

Step 70 is executed when the operating region of the internal combustion engine 1 is currently not in the exhaust gas recycling operating region, and in step 70 the count value X of the counter is decremented by an amount beta. After step 70 control goes to step 80.

In step 80, a test is made as to whether or not the count value X of the counter is greater than 0. When X>0, control returns, whereas otherwise control goes to step 90.

In step 90 the count value of the counter is set to 0.

In step 100, a decision is made that the exhaust gas recycling device has failed, and the indicator lamp 60 is turned on.

In step 110, a decision is made that the exhaust gas recycling device has not failed, and the indicator lamp 60 is turned off or is not turned on.

By carrying out diagnosis of the exhaust gas recycling device according to the flowchart as described above, the count value X of the counter is increased with time more rapidly the higher the intake air flow rate Q, or in other words when the exhaust gas flow rate is high and the exhaust gas temperature is high so that the exhaust gas recycling passage temperature rises more rapidly, and thereby the so-called decision pending time is set appropriately according to the manner in which the temperature of the exhaust gas recycling passage is rising, and the diagnosis decision of the exhaust gas recycling device is carried out from the exhaust gas recycling passage temperature when the count value X is at least a certain value Xset, in other words after a certain decision pending time has elapsed, thus allowing accurate diagnosis.

Although the invention has been described and shown with respect to some preferred embodiments thereof, it should be understood by those of ordinary skill in the art that various modifications are possible with respect to these embodiments without departing from the spirit of the invention.

We claim:

1. A diagnosis device for an exhaust gas recycling device having: a temperature detecting means which detects the temperature of an exhaust gas recycling passage; an exhaust gas recycling operating region detection means which detects whether or not the operating region is such as to carry out exhaust gas recycling; a counter which is incremented when said exhaust gas recycling operating region detection means detects that the operating region is such as to carry out exhaust gas recycling, and is decremented when the operation region is determined not to be such as to carry out exhaust gas recycling; and a decision means which determines that the exhaust gas recycling has failed when the count value of said counter is at least a certain amount and the temperature detected by said temperature detection means is determined not to be more than a certain value.

2. The exhaust gas recycling device diagnosis device of claim 1, wherein said decision means is constructed so that a decision as to whether or not the exhaust gas recycling passage temperature is not more than a certain value is made only when the count value of said counter is at least a certain value.

3. The exhaust gas recycling device diagnosis device of claim 1, wherein said counter is constructed to carry out a count operation only when the exhaust gas recycling passage temperature is not more than a certain value, and said decision means is constructed to make a failure decision if the count value of said counter reaches a certain value.

4. The exhaust gas recycling device diagnosis device of claim 1, wherein said counter is constructed so that when the operating region is detected by said exhaust gas recycling operating region detection means to be such as to carry out exhaust gas recycling, the count value is incremented until a predetermined maximum value is reached, and when the count value reaches said maximum value the maximum value is maintained, and when the operating region is detected to be such as not to carry out exhaust gas recycling, the count value is decremented.

5. The exhaust gas recycling device diagnosis device of claim 1, further comprising an increment prohibition means which prohibits the incrementing of said counter from the time when the operating region of the internal combustion engine changes from an operating region which is not the exhaust gas recycling operating region to the exhaust gas recycling operating region, until a certain time interval has elapsed.

6. The exhaust gas recycling device diagnosis device of claim 1, wherein said counter is constructed such that the increment amount is set variably at a certain time interval according to the exhaust gas flow rate.

* * * * *